US006230917B1

(12) United States Patent
Whitnell

(10) Patent No.: US 6,230,917 B1
(45) Date of Patent: May 15, 2001

(54) LOCKABLE TWO-PIECE CONTAINER

(75) Inventor: Simon Whitnell, Media, PA (US)

(73) Assignee: Dopaco, Inc., Exton, PA (US)

( * ) Notice: Subject to any disclaimer, the term of this patent is extended or adjusted under 35 U.S.C. 154(b) by 0 days.

(21) Appl. No.: 09/644,543

(22) Filed: Aug. 24, 2000

(51) Int. Cl.[7] ..... B65D 5/00

(52) U.S. Cl. ..... 220/23.87; 229/108; 229/125.125; 229/906

(58) Field of Search ..... 220/345.1, 345.2, 220/350, 351, 23.87, 23.91; 229/107, 106, 125.125, 906, 115

(56) References Cited

U.S. PATENT DOCUMENTS 3,761,010 * 9/1973 Rosenburg, Jr. ..... 229/125.125
4,221,320 * 9/1980 Faller ..... 229/125.125 X
4,279,373 * 7/1981 Montealegre ..... 229/125.125 X
4,283,001 * 8/1981 Meyers ..... 229/108 X
4,779,723 * 10/1988 Focke et al. ..... 229/125.125 X
5,098,013 * 3/1992 France et al. ..... 220/906 X

* cited by examiner

*Primary Examiner*—Steven M. Pollard
(74) *Attorney, Agent, or Firm*—Dennison, Scheiner, Schultz & Wakeman

(57) ABSTRACT

A two-piece, lockable, wedge-shaped container is disclosed which includes a tray portion having upstanding peripheral walls, the front wall of which is higher than the other side walls, and a sleeve portion having a top wall for covering the tray, a smaller bottom wall and a front opening. When fully inserted into the sleeve, the tall front wall of the tray deforms the sleeve top wall and front opening as it passes therethrough, and prevents the tray from being removed from the sleeve thereby locking the tray and sleeve together.

14 Claims, 6 Drawing Sheets

LOCKABLE TWO-PIECE CONTAINER

FIELD OF THE INVENTION

The present invention is directed toward a lockable two-piece container, and more specifically, toward a container comprising a sleeve and a tray slidably receivable and selectively lockable within the sleeve.

BACKGROUND OF THE INVENTION

The fast-food industry uses a wide variety of containers and packaging for serving various food products. One common type of container comprising a base portion and an integral lid connected by a living hinge is often referred to as a "clamshell" container. Such containers are in widespread use, especially for relatively small products such as sandwiches and chicken nugget products. While such containers are versatile and relatively inexpensive, they are not well adapted for use with larger food products.

Pizza, for example, is generally sold in square boxes formed from a relatively heavy grade of corrugated cardboard. Such containers are suitable for holding entire pizza pies, which may be 16 inches in diameter or larger. However, restaurants often sell pizza by the individual slice, or are called upon to wrap one or several slices in a "doggie bag" for patrons who have eaten at the restaurant. To make the slices easy to carry, customers may be given a pizza box large enough for an entire pizza to hold the one or several slices, or the slices may be wrapped in foil. The former method is wasteful, as a large amount of heavy cardboard is used to hold as little as one slice of pizza. This method can also be messy—a single slice of pizza is apt to slide from side to side in a large pizza box, and may be damaged when carried by a patron. The latter method provides no support for the pizza and the wrapping often sticks to the melted pizza cheese. Furthermore, a foil-wrapped slice of pizza generally requires two hands to carry, and when the pizza is wrapped and given to the customer hot, the foil provides very little thermal insulation.

Clamshell containers have also been used for individual pizza slices. U.S. Pat. No. 5,788,145, for example, shows a one-piece, triangular clamshell container useful for holding a single slice of pizza. A single pizza slice, however, is often 8 to 10 inches long. A hinged clamshell container for this slice would therefore be at least 16 to 20 inches long when open. While such containers can be nested when stored, their length makes them awkward to use and may present storage difficulties—they may be too long to fit on a shelf having a normal width, for example. Such containers can be stored in a closed configuration to reduce their length, but in this configuration they cannot be nested and they take up a large volume of space, again leading to storage inefficiencies.

It would therefore be desirable to provide a storage container for a single slice of pizza or similar food product that is easy to use and that can be stored in a space-efficient manner while still providing the benefits of an inexpensive, lockable clamshell-type container.

SUMMARY OF THE INVENTION

The present invention overcomes these and other problems by providing a two piece, lockable container shaped to accommodate a slice of pizza. While the preferred embodiment will be described herein in terms of a container for a single slice of pizza, it will be appreciated that the container could also be used to hold multiple slices of pizza or to hold other wedge shaped items such as slices of pie or cheese, or even various non-food items.

The preferred embodiment of the invention comprises a wedge-shaped tray with upstanding peripheral walls and a blunt front end which walls and front end define a top opening for receiving a slice of pizza. The tray is preferably about one inch deep, but can be sized appropriately for different types of product—thin pizzas versus deep-dish pizzas, for example. The top opening is larger than the tray bottom wall so that multiple trays can be nested. The invention further comprises a separate wedge-shaped sleeve having a narrow front end and wide back end for receiving the tray and holding the tray in place after insertion in the sleeve. The sleeve includes a top wall slightly larger than the top opening of the tray and depending side walls defining a front opening about the same size as the tray front wall end. The side walls are located only near the front opening to reduce the amount of paperboard needed for the sleeve. The sleeve side walls include fold lines running parallel to the top wall which allow the side walls, and hence the sleeve, to collapse and be stored in a flat configuration.

The front end of the tray comprises a wall somewhat taller than the rest of the tray peripheral walls and also somewhat taller than the height of the sleeve front opening when the sleeve is in an open configuration with its top wall parallel to its bottom wall. However, the sleeve is flexible enough to permit the passage of this oversized wall portion. In use, therefore, a slice of pizza is place into the tray and the blunt front end of the tray is passed under the rear end of the sleeve and toward the front sleeve opening. As the bottom side of the tray bottom wall engages the top side of the sleeve bottom wall, the top edge of the tray front wall is pushed up against the underside of the tray top wall. The flexible top wall bows outwardly to allow the tray to pass. The tray and sleeve are sized so that the tray front wall can pass just beyond the sleeve front opening before the tray side walls engage the sleeve side walls to stop further movement. As the tray front end exits the sleeve, the sleeve top wall returns to a generally flat configuration. Because the tray front end is taller than the sleeve front opening in its relaxed state, the tray is effectively locked in place and will not slide out of the sleeve. To remove the tray, the sleeve or tray or both must be deformed to allow the tray to pass back through the sleeve front opening.

It is therefore a principal object of the present invention to provide a lockable two-piece container.

It is another object of the invention to provide an improved two-piece wedge-shaped container.

It is a further object of the present invention to provide a sleeve cover for a tray which sleeve covers less than the entire bottom wall of the tray.

It is still another object of the present invention to provide a passive locking mechanism for a paperboard container comprising a tray and a sleeve.

It is still a further object of present invention to provide a two piece tray and sleeve container wherein the tray portion is stackable and the sleeve portion is collapsible for space efficient storage.

BRIEF DESCRIPTION OF THE DRAWINGS

These and other objects of the invention will be better understood after reading the following detailed description of the preferred embodiment of the invention in connection with the following drawings, wherein.

DETAILED DESCRIPTION OF THE PREFERRED EMBODIMENTS

Figure 1:
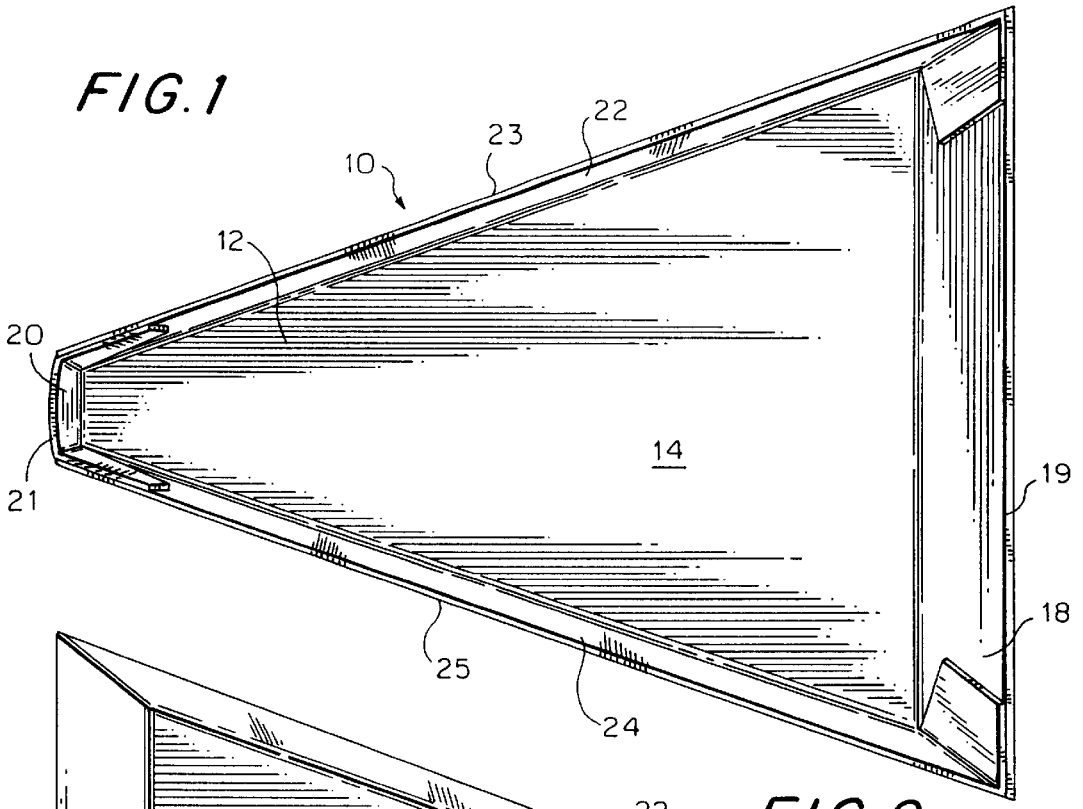
FIG. 1 is a top plan view of the tray portion of the container of the subject invention.
Figure 2:
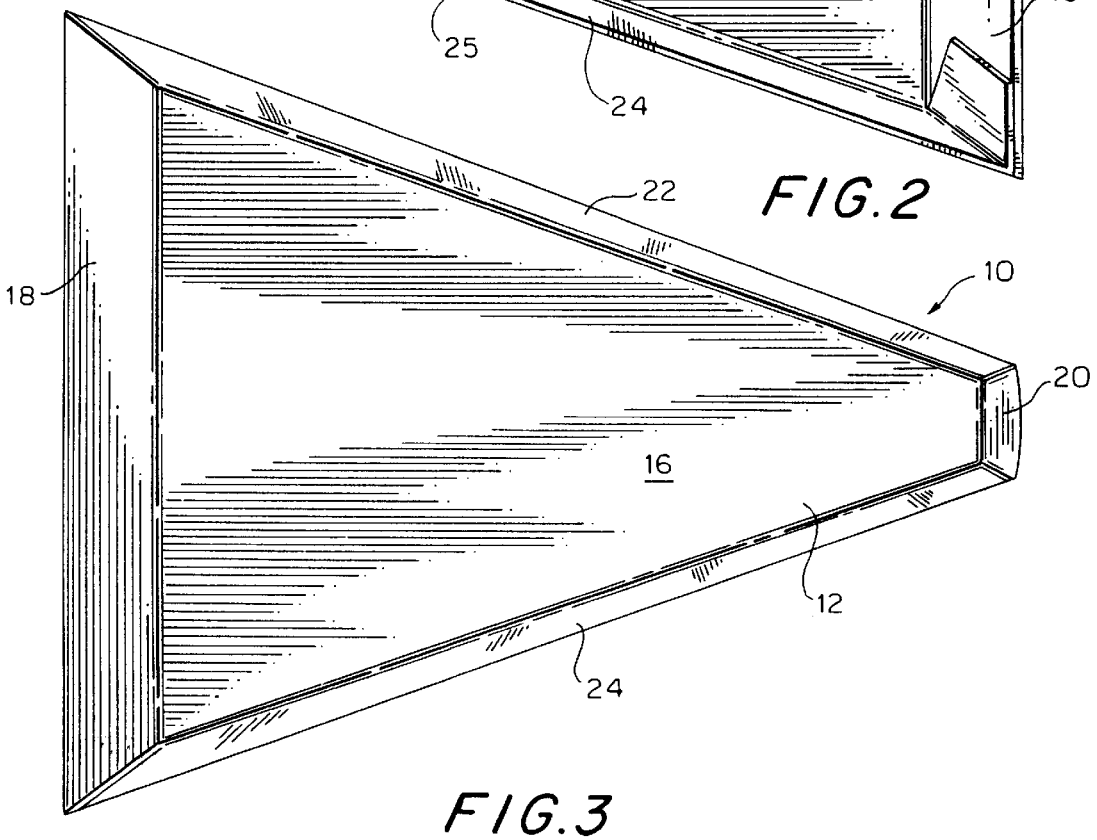
FIG. 2 is a bottom plan view of the tray of FIG. 1.
Figure 3:
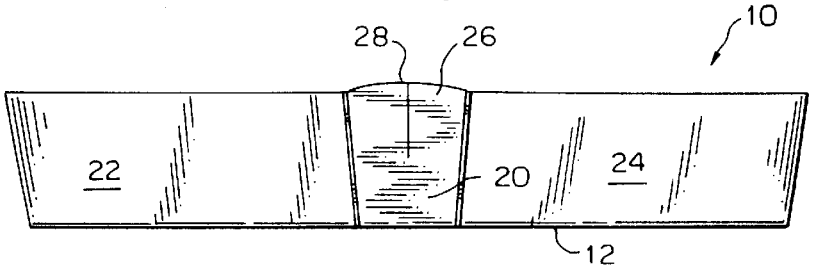
FIG. 3 is a front elevation view of the tray of FIG. 1.

Referring now to the drawings, wherein the showings are for the purpose of illustrating a preferred embodiment of the invention only, and not for the purpose of limiting same, FIGS. 1 and 2 show a tray 10 comprising a generally triangular tray bottom 12 having a top face 14 and a bottom face 16. Tray 12 includes four peripheral walls extending upwardly and outwardly from the periphery of the bottom wall including a back wall 18 having a top edge 19, a front wall 20 having a top edge 21, and a first side wall 22 having a top edge 23 and a second side wall 24 with a top edge 25, which side walls extend between the front and back walls. Front wall 20 is narrower than back wall 18, and therefore the side walls converge toward the front wall in the direction from the rear wall.

In this preferred embodiment, the front wall has a small width; however the width of the front wall could be increased or even decreased until the tray bottom was essentially triangular. In such case the front wall would comprise the thickness of the end portions of the converging side walls, and would function in a similar manner to the tray of the preferred embodiment.

Side walls 22, 24, and rear wall 18 are generally the same height. For reasons described hereinafter, front wall 20 is taller than the other walls and its top edge 21 is higher than top edges 23, 25 of side walls 22, 24 or top edge 19 rear wall 18.

Figure 4:
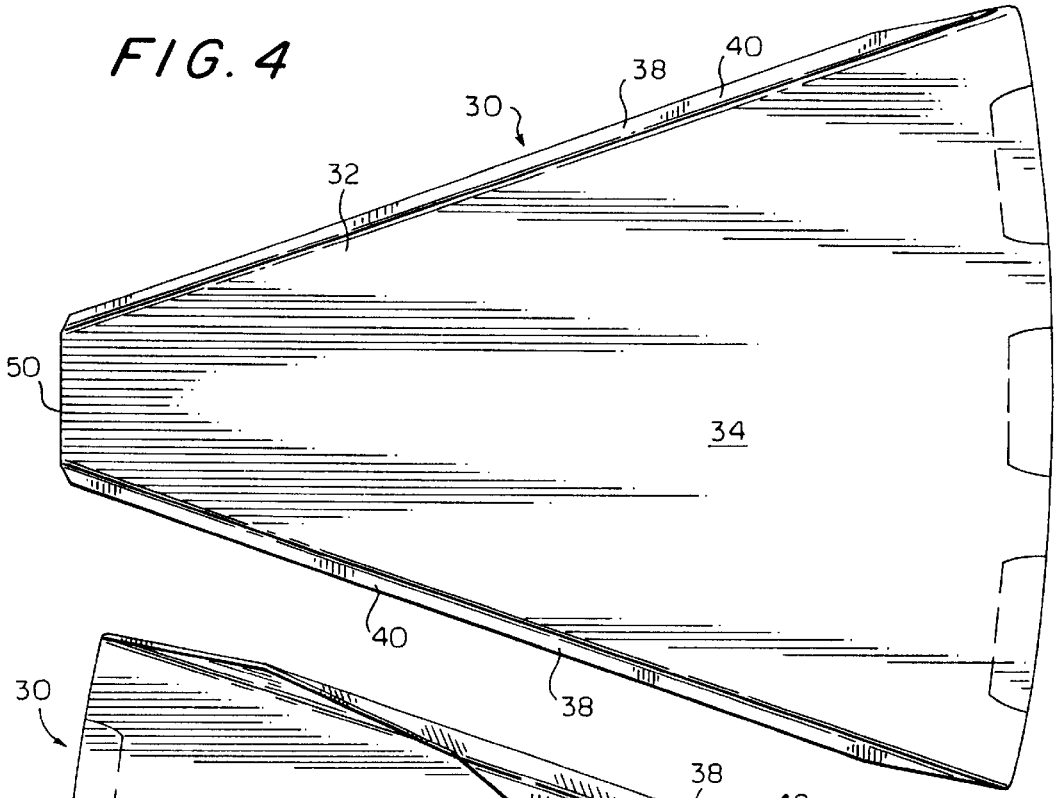
FIG. 4 is a top plan view of the sleeve portion of the container of the subject invention.
Figure 5:
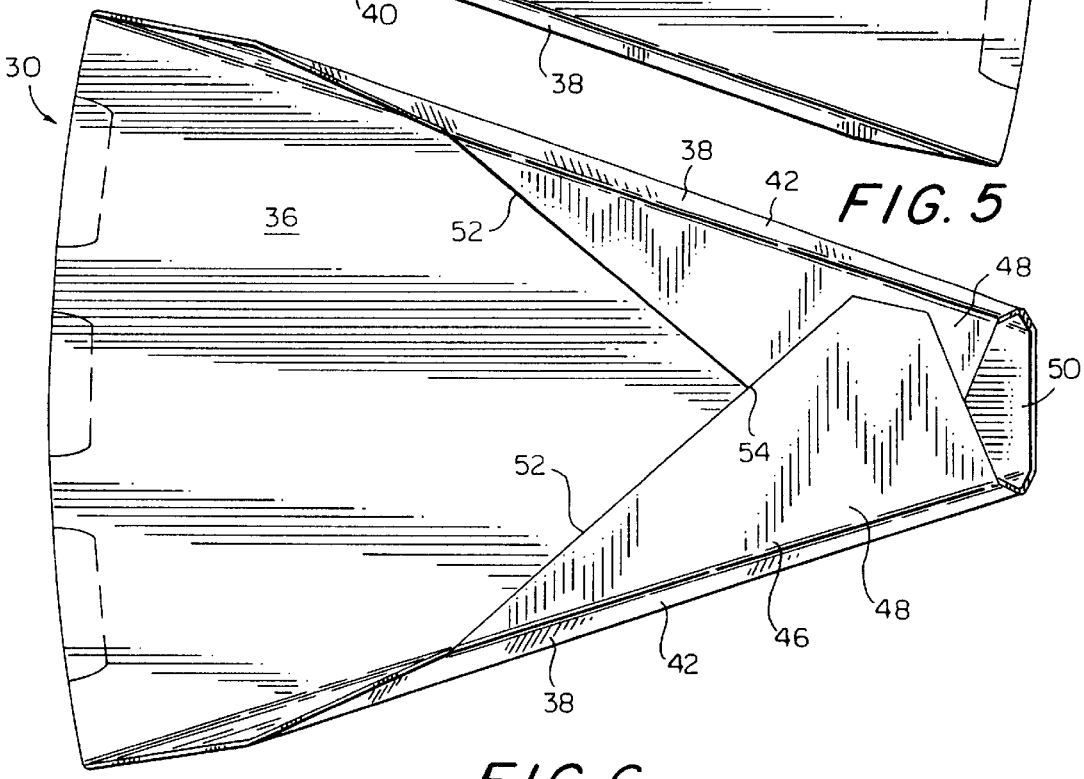
FIG. 5 is a bottom plan view of the sleeve shown in FIG. 4.
Figure 6:
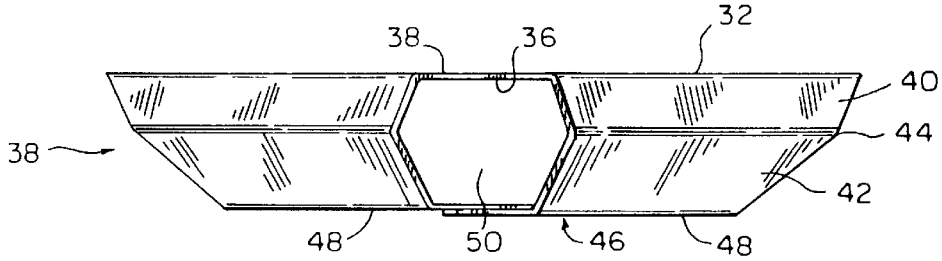
FIG. 6 is a front elevation view of the sleeve of FIG. 4.

FIGS. 4–6 show a sleeve 30 comprising a sleeve top 32 having a top face 34 and a bottom face 36, first and second side walls 38 each having an upper sidewall portion 40 and a lower sidewall portion 42 separated by a fold line 44, and a sleeve bottom 46 comprising side wall extensions 48 glued together beneath sleeve top 32. Sleeve top 32 is generally the same shape as, but somewhat larger than tray bottom 12, and in fact is just large enough to cover the top opening of tray 10 defined by top edges 19, 21, 23 and 25 of the tray sidewalls. Sleeve 30 further includes a front opening 50 defined by sleeve top 32, sidewalls 38 and sleeve bottom 46, and a rear opening defined by the sleeve top and side walls. The presence of the fold lines 44 on the sleeve side walls makes the sleeve collapsible and permits the sleeve to be stored in a substantially flat configuration with the bottom face 36 of sleeve top 32 resting on the top of sleeve bottom 46.

As can be seen in FIG. 5, the sleeve bottom is smaller that the sleeve top and is located only in the area of sleeve front opening 50. Wall extensions 48 which form the sleeve bottom have angled back edge 52 starting at side edges 38 and converging in the direction of front opening 50 and meeting at a point 54. This arrangement could be described as a V-shaped notch in the bottom wall of the sleeve. While a sleeve with a bottom wall comparable in size to sleeve top wall could be used, the preferred arrangement minimizes the amount of paperboard required to make the sleeve and still provides an effective product. When sleeve top 32 is generally parallel to sleeve bottom 46, the distance between bottom wall 46 and bottom 36 of sleeve top 32 is about equal to the height of the tray side walls and is less than the height of tray front wall 20.

Figure 7:
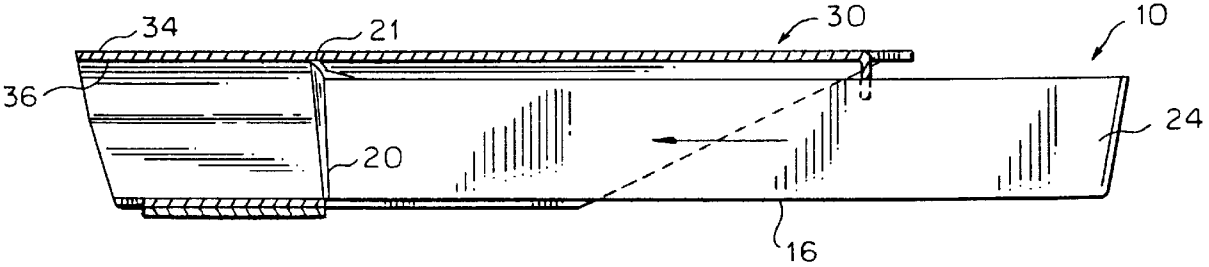
FIGS. 7–9 are side elevation views of the tray of FIG. 1 being inserted into the sleeve of FIG. 4.
Figure 8:
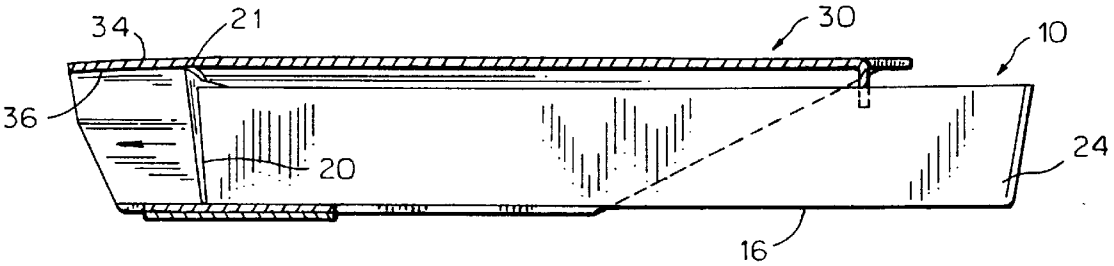
Figure 9:
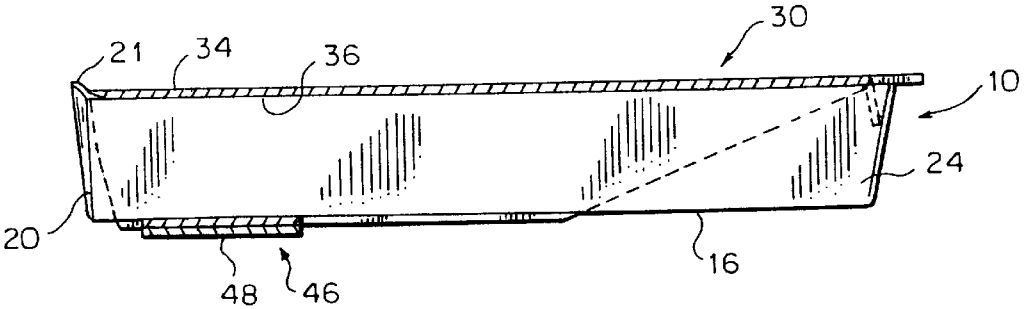

The operation of the tray and sleeve will now be described with reference to FIGS. 7–9. In use, a tray 10 is removed from a nested stack of similar trays and an item of food, such as a slice of pizza or pie is place therein. A sleeve 30 is then erected by squeezing the fold lines 44 of the sidewalls together or by inserting a user's hand between sleeve bottom and sleeve top. While holding the sleeve in one hand and the tray in the other, tray front wall 20 is positioned under sleeve top 32 and brought to a location near meeting point 54 of the angled edge portions 52 of sleeve bottom 46. This is shown in FIG. 7. Since tray front wall 20 is taller than the distance separating sleeve bottom from sleeve top, top edge 21 of front wall 20 deforms the top of sleeve 30 when the tray is inserted further into the sleeve. This can seen in FIG. 8. The paperboard material from which the container is formed and the presence of the fold line 44 in the side walls 38 allows the sleeve to deform sufficiently to allow the passage of the tray front wall through the sleeve. Alternately, or in addition, the top of the tray front wall may be somewhat flexible to facilitate its passage through the sleeve. As tray front wall 20 exits through sleeve front opening 50, sleeve top wall 32 flexes back to a position generally parallel to the sleeve bottom wall as shown in FIG. 9. At this point sleeve top wall 32 substantially covers tray 10 to completely enclose the food items therein and is parallel to bottom wall 46. Because front wall 20 is taller than the height of opening 50, the tray is effectively prevented from sliding out of the sleeve and is locked in place by the portion of the tray front wall extending above sleeve top wall 32.

Figure 10:
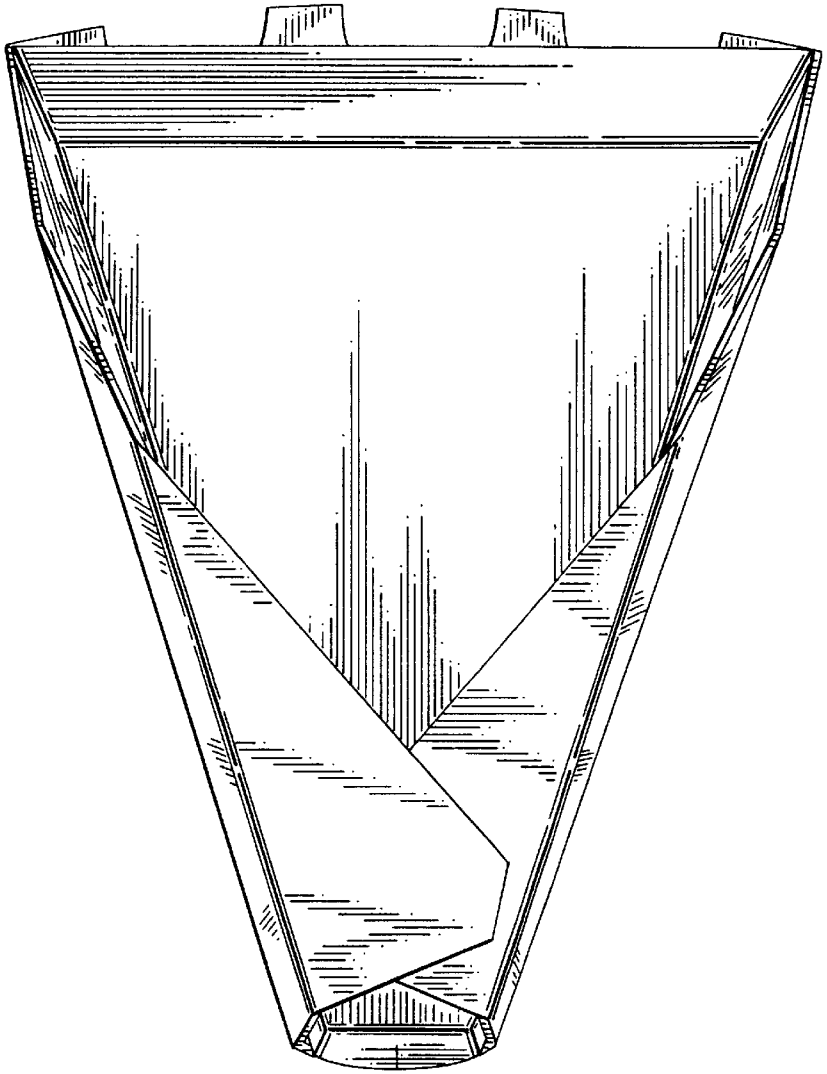
FIG. 10 is a bottom plan view of the subject tray locked in the subject sleeve.

The sizes of tray 10 and sleeve 30 are selected such that motion of the tray into the sleeve is stopped by the sidewalls 22, 24 coming into contact with sleeve side walls 38 immediately after tray front wall 20 passes through sleeve front opening 50. This locked position is also shown in FIG. 10. A user can remove the tray from the sleeve by pinching sidewalls 44 together and/or by flexing the sleeve top wall 32 away from the tray to temporarily enlarge front opening 50 enough to accommodate tray front wall 20.

Figure 11:
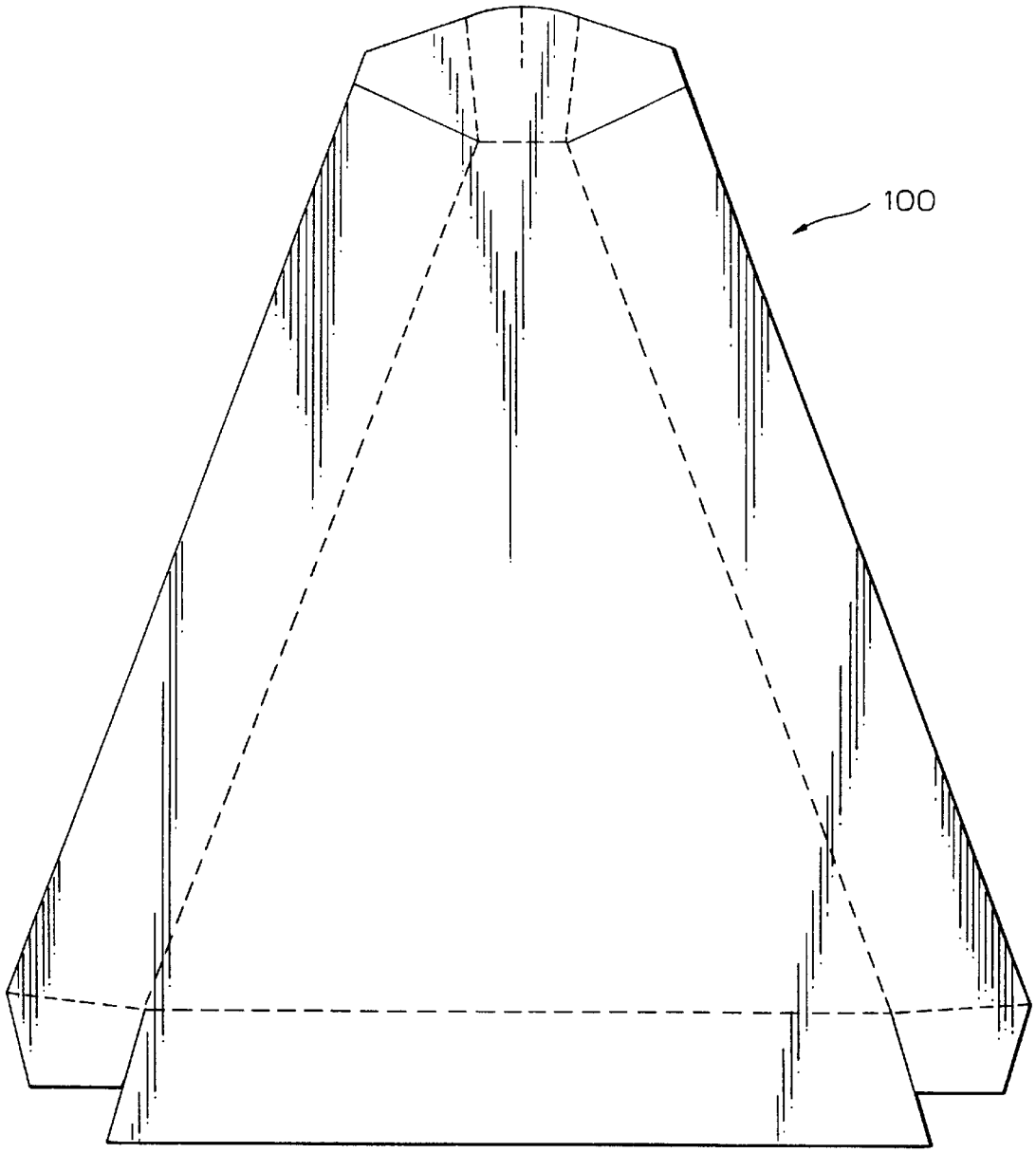
FIG. 11 is a top plan view of a blank used to form the tray of FIG. 1; and, FIG. 12 is a top plan view of the blank used to form the sleeve of FIG. 4.
Figure 12:
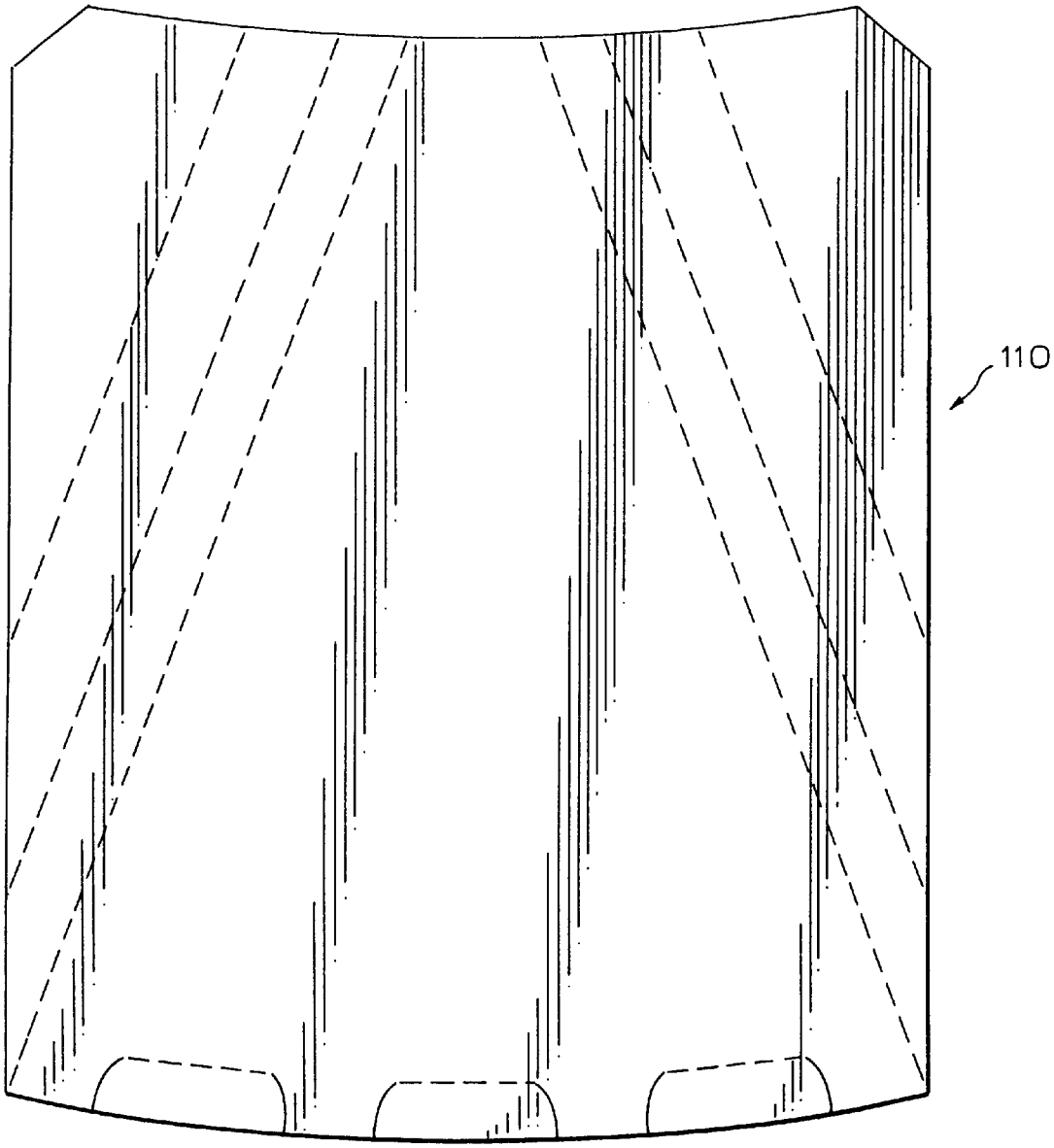

FIG. 11 shows a blank 100 for forming the tray of the subject invention while FIG. 12 shows a blank 110 for forming the above-described sleeve.

The present invention has been described herein with reference to a preferred embodiment. However, obvious modifications and additions to this embodiment will become apparent to those skilled in the art upon a reading and understanding of this specification. For example, the width of the front wall of the tray could be reduced or increased without departing from the idea of this invention. It is the applicant's intention that all such obvious modifications comprise a part of this invention to the extent that they are included within the scope of several claims appended hereto.

I claim:

1. A container comprising:

a wedge-shaped tray having a bottom wall and upstanding sidewalls; and, a wedge-shaped sleeve for slidably receiving said tray;

wherein said tray includes tab means for engaging a wall of said sleeve when said tray is inserted a first distance into said sleeve.

2. The container of claim 1 wherein said tray includes a front wall and said tab means comprises a portion of said front wall.

3. The container of claim 2 wherein said tab means comprises a portion of said front wall extending away from said front wall and away from said bottom wall.

4. The container of claim 2 wherein said sleeve comprises a top wall and said tab means engages said top wall when said tray is inserted a first distance into said sleeve.

5. The container of claim 1 wherein said sleeve is deformable to allow passage of said tab means therethrough.

6. The container of claim 1 wherein said tab means comprises an integral portion of said tray.

7. The container of claim 1 wherein said sleeve is collapsible to a substantially flat configuration.

8. The container of claim 1 wherein said sleeve comprises a top wall and a bottom wall, said bottom wall being less than half the size of the top wall.

9. The container of claim 8 wherein said sleeve includes a front opening and said sleeve bottom wall includes a first edge having a V-shaped notch.

10. A two piece container comprising a support member and a housing for slidably receiving said support member, said support member having a first end with a height and a width and a second end with a height and a width, said second end width being greater than said first end width;

said housing having a first end opening and a second end opening connected by a passage, said first end opening having a width less than the width of said support member second end and a height;

said support member first end height being greater than the height of said support member first end opening;

a portion of said housing or said support member being flexible to allow said support member first end to pass through said housing, exit said housing first end opening, and return to an un-flexed state;

whereby the height of said support member first end prevents said support member from passing back through said housing first end opening without deforming said housing or said first end.

11. In combination, a sleeve and a tray slidably receivable in said sleeve, said tray comprising a bottom wall, first and second upstanding end walls and first and second upstanding side walls, said first end wall having a width less than the width of said second end wall and a height greater than the height of said second end wall, said end walls and side walls defining a tray top opening; and, said sleeve comprising a top wall larger than said tray top opening and having a first end having a first end length and a second end having a second end length, and first and second side edges, said second end length being greater than said first end length, and first and second side walls depending from said first and second side edges, respectively, said first side wall connecting to said second side wall to form a sleeve bottom wall;

said sleeve top wall and first and second side walls defining a sleeve first end opening having a height less than the height of said tray first end wall;

said sleeve being shiftable from a first configuration wherein said first end opening has a height less than the height of said tray first end wall and a second configuration wherein said first end opening has a height greater than the height of said first end wall.

12. The sleeve and tray combination of claim 11 wherein said sleeve is shiftable to a third configuration wherein said sleeve is substantially flat.

13. A blank for forming a tray lockably receivable within a flexible sleeve, said blank comprising a truncated triangular panel having a base edge, first and second side edges and a top edge, first, second and third side wall panels extending outwardly from said base edge and said first and second side edges, each having a panel outer edge, and a front wall panel extending outwardly to a panel front wall outer edge, wherein said panel front wall outer edge is convex.

14. The blank of claim 13 wherein each of said first, second and third side wall panels has a width between said truncated triangular panel and each of said first, second and third panel outer edges, and said front wall panel has a maximum width between said top edge and said front wall convex outer edge, said maximum width of said front wall panel being greater than the width of said side wall panels.

* * * * *